US006111181A

United States Patent [19]

Macon et al.

[11] Patent Number: 6,111,181

[45] Date of Patent: Aug. 29, 2000

[54] SYNTHESIS OF PERCUSSION MUSICAL INSTRUMENT SOUNDS

[75] Inventors: Michael W. Macon, Portland, Oreg.; Wai-Ming Lai, Plano, Tex.; Alan V. McCree, Dallas, Tex.; Vishu R. Viswanathan, Plano, Tex.

[73] Assignee: Texas Instruments Incorporated, Dallas, Tex.

[21] Appl. No.: 09/072,400

[22] Filed: May 4, 1998

Related U.S. Application Data

[60] Provisional application No. 60/045,968, May 5, 1997.

[51] Int. Cl.[7] ..... G10H 7/00

[52] U.S. Cl. ..... 84/603; 84/661

[58] Field of Search ..... 84/603, 659, 661

[56] References Cited

U.S. PATENT DOCUMENTS

| | | | |
|---|---|---|---|
| 4,520,499 | 5/1985 | Montlick et al. . | |
| 5,293,448 | 3/1994 | Honda . | |
| 5,432,296 | 7/1995 | Takeuchi et al. | 84/661 |
| 5,502,277 | 3/1996 | Sakata | 84/661 |
| 5,508,473 | 4/1996 | Chafe | 84/661 X |
| 5,748,513 | 5/1998 | Duyne | 84/661 X |
| 5,777,255 | 7/1998 | Smith, III et al. | 84/661 |

*Primary Examiner*—Jeffrey Donels
*Attorney, Agent, or Firm*—Robert L. Troike; Frederick J. Telecky, Jr.

[57] ABSTRACT

A synthesis of percussion musical instruments sounds is provided using a microprocessor (17) that implements an all pole lattice filter and applying either a single impulse signal to the filter or N samples of an excitation signal sequence to the filter by a memory (19). The coefficients of the filter are determined by storing digital samples (501) of desired musical note from a desired percussion instrument, generating a Fourier transform to get a spectrum (502), picking the peaks of the spectrum (503) to select the most prominent components in the spectrum and determining wanted frequencies for decaying sine waves and for the frequencies finding the time envelope and estimating therefrom the pole radius.

5 Claims, 5 Drawing Sheets

SYNTHESIS OF PERCUSSION MUSICAL INSTRUMENT SOUNDS

This application claims priority under 35 USC § 119(e) (1) of provisional application number 60/045,968, filed May 8, 1997.

TECHNICAL FIELD OF THE INVENTION

This invention relates to synthesis of sounds and more particularly to the synthesis of percussion musical instrument sounds.

BACKGROUND OF THE INVENTION

The Mixed Signals Products group of Texas Instruments Semiconductor Division (SC/MSP) has an LPC (Linear Predicting Coding) synthesis semiconductor chip business with its family of TSP50C1X and MSP50C3X microprocessors. The synthesis is where a signal such as a human voice or sound effect such as animal or bird sound to be synthesized is first analyzed using a linear predictive coding analysis to extract spectral, pitch, voicing and gain parameters. This analysis is done using a Speech Development Station 10 as shown in FIG. 1 which is a workstation with a Texas Instruments SDS5000. The SDS5000 consist of two circuit boards 10*a* plugged into two side by side slots of a personal computer (PC). The PC includes a CPU processor and a display and inputs 10*b* such as a keyboard, a mouse, a CD ROM drive and a floppy disk drive. Using one of the inputs like a CD ROM, the voice or sound to be synthesized is entered for analysis. The station also includes a speaker 10*c* coupled to the PC and the user editing can listen to the sound as well as view the display generated by the SDS5000. The analysis is typically done at a rate of 50–100 times per second. The display gives a time plot of the raw speech spectrum, pitch, energy level and LPC filter coefficients. These parameters may then be edited, if necessary, and quantized to a data rate of typically 1500–2400 bits/second. The data rate is kept low to reduce the memory needed to store the data in the product being created. The foregoing analysis is performed off-line and the LPC parameters are stored into the memory M of a synthesis product such as a talking toy or book 15 shown in FIG. 2. The book for example contains a microprocessor $\mu$P 17 that is coupled to a ROM memory M 19 that when a button 20 is pressed processes using LPC model data to produce the sound to a speaker S. The digital signal is converted to analog signal and applied to a speaker in the book or toy. The coefficients for that sound corresponding to the button depressed are taken from the memory.

In many applications, it is desirable to synthesize not only speech, but also sound effects or musical instrument sounds as well. Some interments can be modeled fairly well using the pitch-excited LPC model above, since heir spectra consist of harmonically-related partials shaped by a spectral envelope. However percussion sounds, i.e. sounds created by striking or plucking a string or other object, often do not fit this model. The modes of vibration or partials (frequency components) created by striking a xylophone bar, for example, are related to the physical dimensions of the bar itself. This means that the modes are, in general, not related to each other by an integer multiple of some fundamental frequency. The pitch-excited LPC model is incapable of producing aharmonic tones, thus it is not well-suited to synthesizing such sounds.

The physical behavior of struck objects suggests that they can be modeled by a sum of sinusoids with exponentially decaying amplitudes. See A. H. Benade, *Fundamentals of Musical Acoustics,* Dover Publications, Inc. 1990. Examples of other work in this area include J. Laroche and J. L. Meillier, "Multichannel excitation/filter modeling of percussive sounds with application to the piano," IEEE Transactions on Speech and Audio Processing, Vol. 2, pp. 329–344, April 1994 in which a high order excitation/filter model is used to represent piano tones, and J. Laroche, "A new analysis/synthesis system of musical signals using Prony's method: Application to heavily damped percussive sounds," in Proceedings of the International Conference on Acoustics, Speech, and Signal Processing, pp. 2053–2056, IEEE, April 1989, in which percussion sounds are created by explicit synthesis of time-varying exponentials.

One straightforward approach is to perform LPC analysis on the signal to be synthesized. The reflection coefficients must be hand-edited to obtain good synthesized output. However, even with fine tuning, LPC analysis often does not give satisfactory results. This is due to the fact that the LPC model is only good for human vocal tract, but not good for musical instruments.

Another way to generate musical notes in the synthesizer chip is to use the PCM mode, in which a sampled waveform is loaded directly into the D/A converter. This produces very high quality output but requires a large amount of memory for storing the samples. An alternative method is to generate sine waves at different frequencies for various tones. In this case, only one period of each sine wave needs to be stored and this reduces the data rate significantly. However, a drawback of this approach is that the output is very synthetic and does not sound like any musical instrument due to the lack of harmonics.

The TSP50C1X and MSP50C3X chips implement an all-pole lattice filter to which can be input a periodic pulse train, pseudo-random noise, or an excitation sequence stored in memory 19.

The LPC method models short-time segments of the speech signal as the response of an all-pole filter to an impulse input. A frame-by-frame analysis of 20–30 ms duration windowed segments is often used, and the filter parameters are updated in time and interpolated during the synthesis process. For a review of LPC, see J. Makhoul's article entitled, "Linear Prediction: A Tutorial Review," Proc. of IEEE, Vol. 63, pp. 561–580, April 1975.

SUMMARY OF THE INVENTION

According to one embodiment of the present invention the synthesis of percussion musical instrument sounds is provided by applying a single impulse to an all-pole lattice filter provided in the microprocessor chip where the filter has conjugate poles and a filter coefficients to produce the desired sound.

In accordance with another embodiment of the present invention is the method for finding the parameters to synthesize the sound.

DESCRIPTION OF THE DRAWINGS

In the drawing:

FIG. 6 illustrates peak-picking results where dotted line corresponds to spectral tilt, asterisks mark selected peaks where

FIG. 8*a* illustrates the weighting vector and FIG. 8*b* the filter output (dashed lines) and exponential fit;

DESCRIPTION OF THE PREFERRED EMBODIMENT

Figure 3:
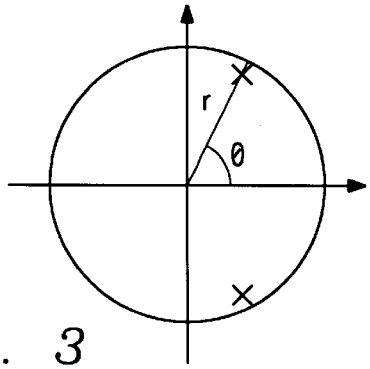
FIG. 3 is a z plane sketch of a filter with a unit circle and a pair of conjugate poles.
Figure 4:
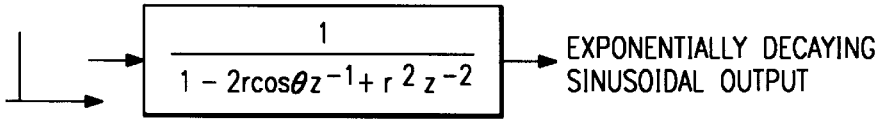
FIG. 4 illustrates a second-order filter with coefficients in terms of $\theta$ and r.

In order to find a better way to synthesize musical instruments, a new approach is considered. This is based on the fundamental theory of digital filtering. Suppose a filter is provided with a pair of conjugate poles, as shown in the z-plane diagram in FIG. 3. The impulse response of this filter will be an exponentially decaying sinusoidal signal with frequency of oscillation determined by the angular frequency θ and rates of decay determined by the damping constant r. FIG. 4 shows the corresponding filter coefficients in terms of r and θ. If the input is an impulse or a single pulse, the output will be a pure gradually diminishing tone which will sustain for a period of time. By controlling r and θ, tones of different pitch and duration can be generated.

This filter can be realized as a second-order LPC filter with $a_0=1$, $a_1=-2r\cos\theta$ and $a_2=r^2$. Theoretically, valid results for any value of r and θ can be obtained. However, as the filter is being implemented in a fixed-point synthesizer chip, the results will be affected by finite word-length effects. It is well known that due to quantization of the filter coefficients, there are limits on the frequencies of oscillation that can be obtained. In addition, the representation of signals as fixed-point numbers introduces quantization noise and overflow errors. Small-scale limit cycles due to nonlinear quantization and large-scale limit cycles due to nonlinear overflow are also serious problems caused by fixed-point implementations.

Since finite word-length effects are complex and difficult to analyze, the simplest approach to find the best set of filter coefficients is the analysis-by-synthesis method. In this approach, the coefficients are optimized by comparing the original signal with the synthesized output, which is determined by a fixed-point simulation of the synthesizer chip.

In order to obtain multiple-frequency output, filter sections with poles at different angular frequencies can be cascaded, as shown in the following expression. Since the synthesizer chip uses a 12-pole LPC filter, a maximum of six second-order sections is allowed. The multiplication of the filter sections has to be computed during analysis so as to obtain the LPC parameters $a_0, a_1, a_2, \ldots, a_{12}$.

$$\frac{1}{1-2r_1\cos\theta_1 z^{-1}+r_1^2 z^{-2}}\cdot\frac{1}{1-2r_2\cos\theta_2 z^{-1}+r_2^2 z^{-2}}\cdot\frac{1}{1-2r_3\cos\theta_3 z^{-1}+r_3^2 z^{-2}}\cdots$$

The envelope of the output can be shaped by changing r during the decaying period. This will change the position of the pole along the same vector on the z-plane. If r is further away from the unit circle, the output will decay faster, and if r is closer to 1, the output signal will sustain longer. One example of changing r in order to match the signal envelope is the xylophone. In the recording of an actual xylophone, the signal decays rapidly during the first 40 msec, followed by a long tail which sustains for about a second. By using a smaller r for the first 40 msec and then increasing r gradually to be closer to 1, it is possible to achieve an envelope very similar to that of the xylophone. The damping constant at different angular frequencies can be set individually so that different frequency components in the same signal have various rate of decay.

The analysis-by-synthesis process can be carried out manually. This means every instrument needs to be analyzed individually and a specific set of routines is required for computing the reflection coefficients and generating the output. This method limits the number of instruments able to be synthesized because it is inefficient and sometimes inadequate to analyze a musical instrument by simply looking at the time waveform and the spectra.

In accordance with a teaching herein an automatic algorithm such that the analysis routine will come up with a set of reflection coefficients automatically whose synthesized output will best fit a given input signal.

Figure 1:
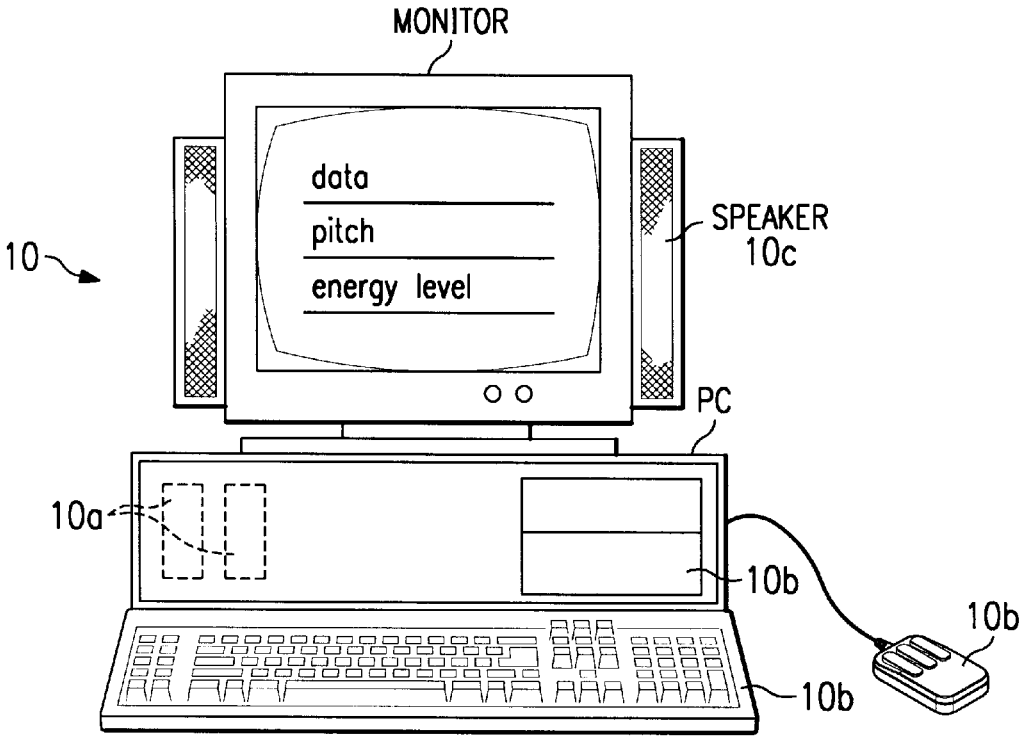
FIG. 1 is a sketch of a Speech Development Station.
Figure 2:
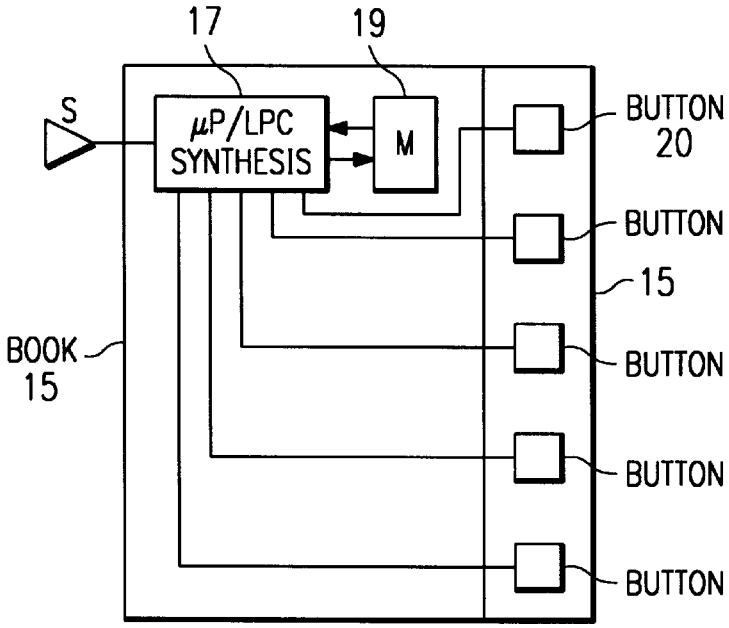
FIG. 2 is a sketch of a synthesis product.
Figure 5:
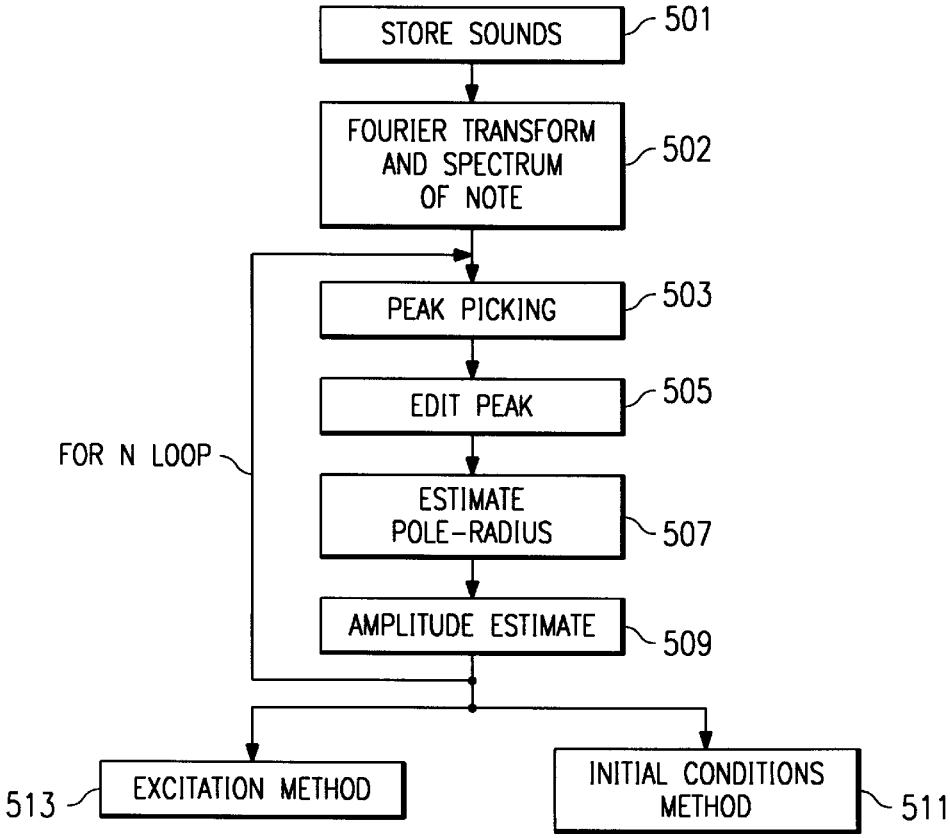
FIG. 5 is a flow chart illustrating an automatic method for finding the parameters to synthesize a sound according to one embodiment of the present invention.
Figure 6A:
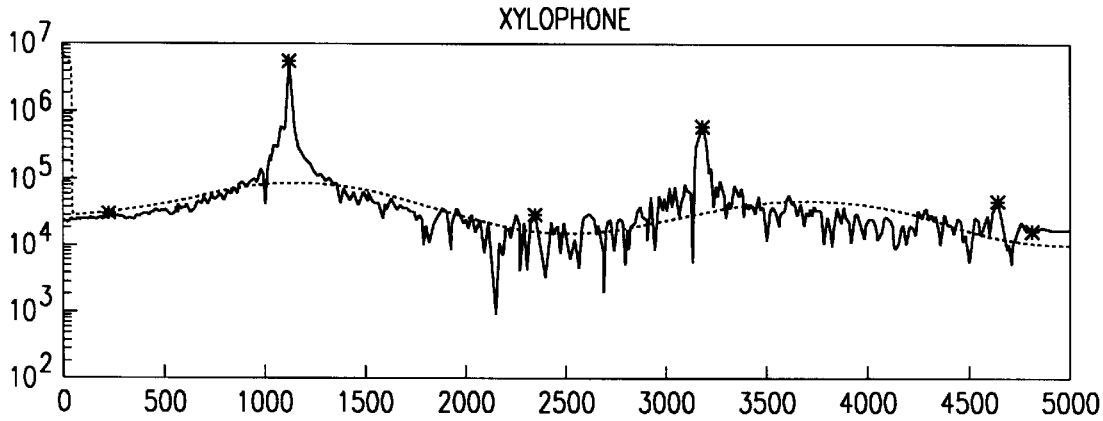
FIG. 6*a* is for xylophone and FIG. 6*b* is for piano.
Figure 6B:
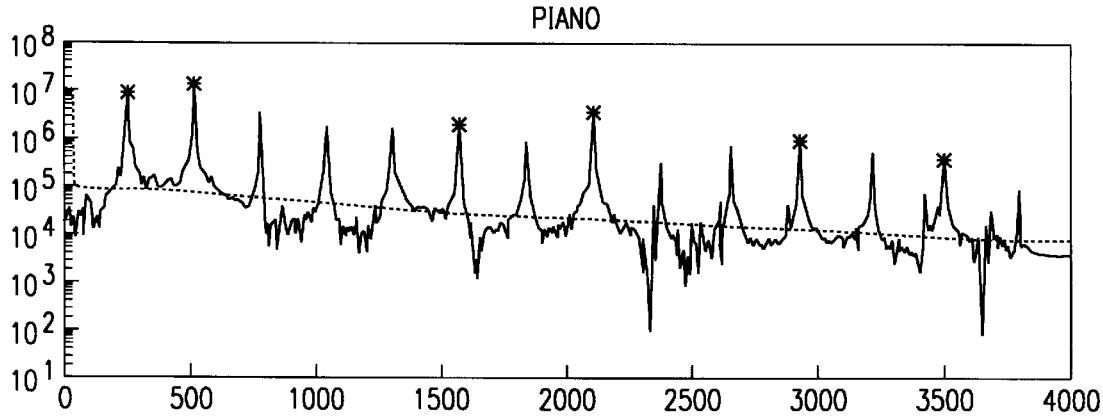

Referring to FIG. 5, there is illustrated an automatic method for finding the parameters necessary to synthesize the sound. The analysis takes the input signal and produces the desired parameters. The parameters are compressed and saved in the memory 19 and the chip 17 will play back the parameters. The first step 501 is to store the digital sound to reproduce in the memory 106 of the PC of FIG. 1. This is a full digital recording of one musical note, sampled at a high bit rate, from a percussion instrument such as a xylophone or piano. For that entire note a long Fourier transform of that note is generated (step 502) via the computer and one gets a spectrum of that note that is displayed as illustrated in FIGS. 6*a* and 6*b*. FIG. 6*a* is for a xylophone and FIG. 6*b* is for a piano. FIG. 6*a* and FIG. 6*b* illustrate the frequencies found in the xylophone and piano signals respectively. The range goes up to 4000 Hz. The program will then pick the peak of the spectrum (step 503) which tells which sine waves (frequencies) to produce the note. The peak picking is to select the most prominent components in the signal. FIG. 6*a* illustrates that the upper limit of six component frequencies (dictated by the synthesis chip) is more than enough to represent the prominent spectral components. The asterisks mark the selected peaks and the dotted line corresponds to the spectral tilt. FIG. 6*b* illustrates the piano note spectrum and the 6 components are not enough so compromises have to be made. The six most important ones are picked automatically and displayed and at that point the program gives the user the option to manually adjust the pick frequencies. The automatic peak picking algorithm is designed to make a reasonable selection of component frequencies. First it finds the highest (biggest) peaks, then it does a weighting around that region so only one is selected in that region and then it finds the next peak. The algorithm is as follows:

1. An FFT (Fast Fourier Transform) of the M samples of the signal is computed, where M is a power of 2. In this implementation M is constrained to $M \geqq 2^{14}$ for computational feasibility. If the signal is short, it is used in its entirety. Since the signal does not usually contain M samples that are a power of 2 append zeros to the end of the signal to make m samples.

2. To eliminate the effects of spectral tilt, the cepstrum of the signal is computed, truncated to its lowest $N_{cep}$ coefficients, and then converted back to a magnitude spectrum $|X_{cep}(\theta^{j\omega})|$. Here, $N_{cep}=5$ is used. For the term cepstrum see text of Oppenheim and Schafer entitled "Discrete-Time Signal Processing," Prentice Hall, 1989.

3. The frequency ω corresponding to the largest amplitude in $|X(e^{j\omega})|/|X_{cep}(e^{j\omega})|$ is chosen as the first peak location.

Figure 7:
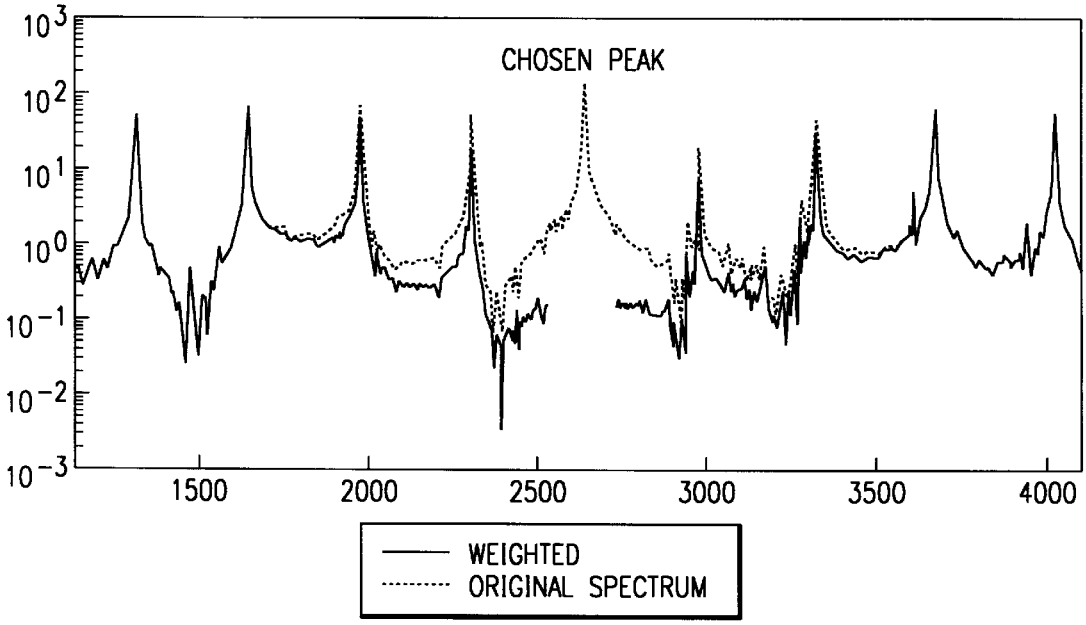
FIG. 7 illustrates spectral weighing during peak picking.

4. The spectrum $|X(e^{j\omega})|/|X_{cep}(e^{j\omega})|$ is weighted in the neighborhood of ω to make further selection of components in this region less likely. For this implementation, a weighting function which slopes from 0 to 1 over a range of 1000 Hz to either side of the chosen frequency is used, and frequencies within 100 Hz of the chosen frequencies are eliminated completely from further consideration in the peak search. An example weighted spectrum is shown in FIG. 7.

5. Steps 3 and 4 are repeated, with peak searches taking place on the updated, weighted spectrum at each iteration. FIGS. 6*a* and 6*b* show the results of this peak picking scheme on the magnitude spectra of a xylophone note and a piano note, respectively. The weighing algorithm attempts to compromise between choosing the largest amplitude components (after tilt removal) and choosing components which are maximally spread in frequency.

One interesting phenomenon observed (discussed more later) is that limit cycles and round-off noise problems in the fixed-point synthesis algorithm tend to be much less severe when poles are spaced further apart from each other in frequency. This observation was an important motivation for the weighting scheme described above.

This algorithm is implemented, for example in a "For N loop, I=1 to 6." Picks one peak, zeros region around the peak and then to the next peak. This determines the wanted frequencies for each second order. What is desired to produce is six decaying sine waves so is the pole radius is needed. In step 507, for the multiple frequencies separate out one frequency, demodulate and filter (one harmonic) to find the time envelope using the Hilbert transform. This is done for each peak as part of the "For N" loop. The Hilbert transform produces $\hat{x}(n)j\omega_i n$ is the demodulation so this is about frequency $\omega_i$ so this is modulated by $\omega_i$ to get down to DC and h(n) is a low pass filter. This gives $x_i(n)$. The magnitude of it is taken and this is the amplitude envelope. This is the amplitude as a function of time. A demodulated partial $x_i[n]$ with frequency $\omega_i$ is separated from the signal x[n] by computing $$x_i[n]=h[n]*(x[n]+j\hat{x}[n])e^{j\omega_i n} \tag{1}$$

where "*" represents convolution, $\hat{x}[n]$ is the Hilbert transform of x[n], and h[n] is the impulse response of a lowpass filter. The quantity $x[n]+j\hat{x}[n]$ is a complex signal with a Fourier transform that is the same as $X(e^{j\omega})$ for positive frequencies but equal to zero for negative frequencies. In this implementation, h[n] is a length 201 (number of coefficients in the filter) FIR lowpass filter with a cutoff frequency of 150 Hz, designed using a Hamming windowed impulse response.

Given that extraneous frequency components have been adequately filtered out, the complex demodulated partial $x_i[n]$ will have a smooth amplitude envelope $|x_i[n]|$ that can be used to estimate the pole radius (bandwidth).

That time envelope is the signal that is matched with an exponential time curve to determine what the radius should be. Once a given frequency component $x_i[n]$ has been filtered out, its amplitude envelope $x_{env}[n]=|x_i[n]|$ can be found. The pole radius is then estimated by finding a correlation coefficient for this amplitude envelope. Experimentally, it was found that using a weighting function to emphasize the less variable "tail" of the exponential decay produces better results. The weighting function w[n] is computed as follows:

$$\omega[n] = \frac{1}{1+\hat{x}_{env}[n]} \tag{2}$$

where $\hat{x}_{env}[n]$ is a smoothed version of $x_{env}[n]$ normalized to the range [0,1]. The weighted estimate of the correlation coefficient is then computed as $$r = \frac{\sum_{n=0}^{N} \omega^2[n]x_{env}[n]x_{env}[n+1]}{\sum_{n=0}^{N} x_{env}^2[n]} \tag{3}$$

Figure 8:
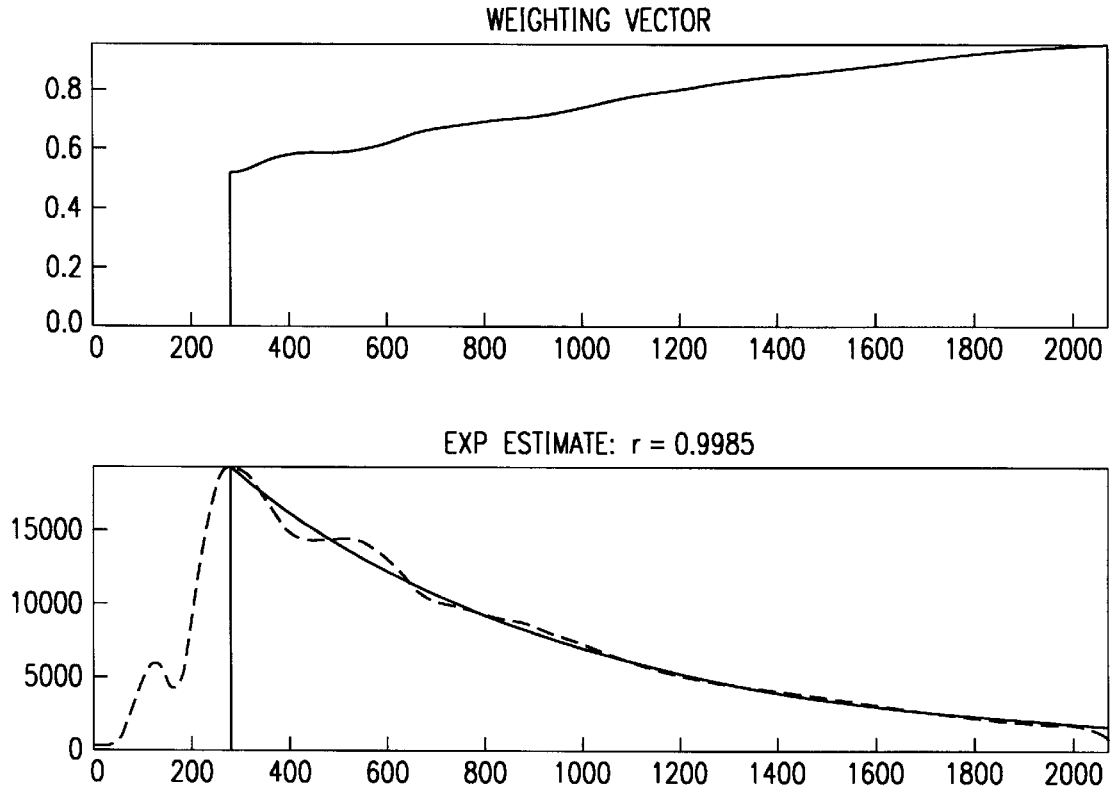
FIG. 8 illustrates pole radius estimating where

FIG. 8 shows the weighting function w[n], the envelopexe $x_{env}[n]$, and the function $$v[n]=a_0 r^{n-n_0} \tag{4}$$

where $n_0$ is the time offset from the beginning of the signal to the maximum of the envelope, and $a_0$ is an initial amplitude found as described in the next paragraph.

This is done for each peak. In FIG. 8, the dashed line is the magnitude for the particular harmonic. The solid line is the filtered decay. This gives the time envelope to match. The best fit corresponds to the pole radius for that pole. The next step 509 to be determined is the initial amplitude of the sine wave start. Given that the pole frequency and radius have been found, it remains to find the initial amplitude of each decaying exponential. The distribution of amplitudes relative to each other affects the timbre, or perceptual quality, of the resulting synthesized sound. Since the decay rate of the function $r^{n-n_0}$ is fixed, the problem or finding the optimal initial amplitude (or gain) can be approached as a simple least-squares minimization problem. Redefining the signals in vector notation, $$X=r^{n-n_0}, n=n_0, \ldots, N$$

$$b=x_{env}[n], n=n_0, \ldots, N$$

Then the amplitude that minimizes the squared error is $$a_0 = \frac{x^T b}{x^T x} \tag{5}$$

Once the amplitude is determined a filter is needed to produce that amplitude. The previous section described a method for finding a set of frequencies and radii of poles to represent resonances of a musical instrument, as well as the relative amplitudes of these modes of oscillation. Exciting a filter having poles at these locations in the z-plane with an impulse will produce resonances of the desired frequencies and decay rates. However, the relative amplitudes of these modes of oscillation cannot be controlled by the pole locations. Rather, these mode amplitudes are a function of the input to the system. Therefore it is not possible to control the mode amplitudes using only a single impulse input.

The approach taken in this section (step 511) is to specify a set of initial conditions for the delay elements of the filter such that the modes are properly excited when the filter is run from this initial state. This is analogous to the physics of many percussion instruments as well. For instance, pulling a guitar string to an initial state and releasing it excites certain modes more than others, depending on where the string is plucked along the neck of the guitar. A mode amplitude "recipe" can be found for each point along the guitar's neck. An equivalent method also relies on a simple transformation of this initial condition vector to an equal number of samples input directly into the filter. This method is more suitable for implementation on the hardware.

Figure 10:
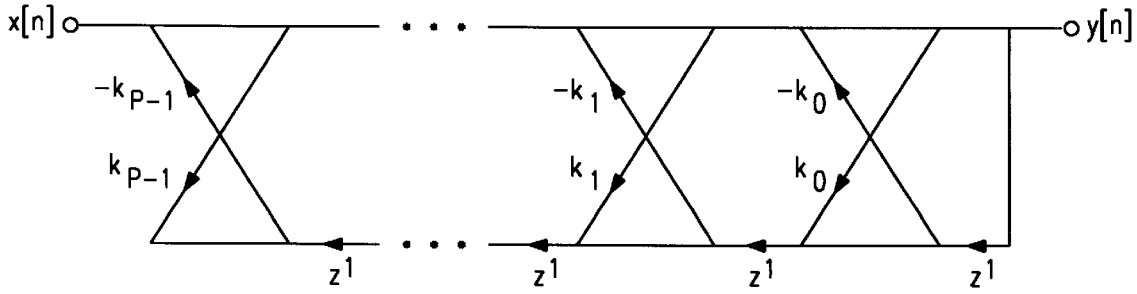
FIG. 10 illustrates an all-pole lattice filter.

To find initial conditions for the filter, it is advantageous to view the lattice filter in the synthesis chip as a state-space system:

$$x_n = Ax_{n-1} + Bu[n] \tag{6}$$

$$y[n] = Cx_n \tag{7}$$

where u[n] is the filter input and y[n] is the filter output. P is the number of poles in the system, and $x_n$ is a P×1 state vector containing the values in the filter delay registers from right to left across the bottom branch of FIG. 10 at time n. The matrices A, B, and C describe the lattice filter and can be written as $$A = \begin{bmatrix} 1 & & & & \\ & k_0 & & & \\ & & k_1 & & \\ & & & \ddots & \\ & & & & k_{P-2} \end{bmatrix} \begin{bmatrix} -k_0 & -k_1 & \cdots & & -k_{P-1} \\ -k_0 & -k_1 & \cdots & & -k_{P-1} \\ & -k_1 & -k_2 & \cdots & -k_{P-1} \\ & & -k_2 & \ddots & \vdots \\ & & & \ddots & \\ & & & -k_{P-2} & -k_{P-1} \end{bmatrix} + \begin{bmatrix} 0 & & & & \\ 1 & 0 & & & \\ 0 & 1 & \ddots & & \\ & \ddots & \ddots & & \\ & & & 1 & 0 \end{bmatrix} \tag{8}$$

$$B = \begin{bmatrix} 1 \\ k_0 \\ k_1 \\ \vdots \\ k_{P-2} \end{bmatrix} \tag{9}$$

$$C = [\, -k_{P-1} \quad -k_{P-2} \quad \cdots \quad -k_0 \,] \tag{10}$$

For the results derived in this section, u[n]=0 for all n, since there is not input to the filter. The problem at hand, then, is to find an initial state vector $x_{-1}$ such that the modes of oscillation will have the proper amplitude relationship to each other in the output y[n] for n>0.

The modes of the system can be isolated from each other by performing an eigendecomposition of the matrix A, $$A = S\Lambda S^{-1} \tag{11}$$

where S is a matrix with the eigenvectors of A in its columns and Λ is a diagonal matrix of eigenvalues. The matrix S is invertable if and only if the eigenvectors of A are linearly independent, and this will always be true for a filter with non-repeated poles, as considered here. The eigenvectors of A correspond to the modes of the system, and the eigenvalues correspond to the rate of decay of each mode.

Since the eigenvectors are linearly independent, the amplitudes and phases of the modes can be adjusted independently in the initial state by making $x_{-1}$ a weighted linear combination of the eigenvectors, $$x_{-1} = \sum_{k=0}^{P-1} g_k v_k \tag{12}$$

where $V_k$ is the kth eigenvector of A and where $$g_k = \frac{a_k e^{j\phi k}}{Cv_k}$$

and $a_k$ and $\phi_k$ are the desired amplitude and phase for the kth mode of the system. (For real signals, P/2 of the coefficients {gk} will be conjugates of some other coefficient.) The phase $\phi_k$ is somewhat arbitrary in this case, and has no effect on the perceptual sound quality. On the average, setting the phases to random numbers seems to decrease the peak-to-RMS ratio of the synthesized signal slightly, resulting in slightly higher power in the output signal for a given peak-to-peak range.

The excitation method (step 513) is an equivalent method to produce the same result. Instead of setting the initial state as $x^{-1}$ the initial state is zero. The initial excitation is described by equation 14. If you have P poles in your filter, P samples are needed to drive the filter into the right state and then it is let go to decay. In this case P=12 samples (12 pole - 6 pole pairs) are provided to drive this in the right place. There is always a pole pair one for positive and one for negative frequencies. The following indicates what these samples should be. In the synthesizer chip, the 12 samples are stored as well as the filter coefficients. The 12 samples are obtained from equation 14.

This method relies on constructing a controllability matrix E, and finding the input u that drives $x_n$ to the desired state at time P, $$x_p = \underbrace{[\, B \quad AB \quad A^2B \quad \cdots \quad A^{N-1}B \,]}_{E} \underbrace{\begin{bmatrix} u[P-1] \\ u[P-2] \\ \vdots \\ u[0] \end{bmatrix}}_{u} \tag{13}$$

The solution for the desired input u is then $$u = E^{-1}x_P \tag{14}$$

Based on the desired amplitude of each of the a (the desired initial amplitude) (k=1 to N) and g is the initial amplitude of the eigenvector used to produce the initial state. The equation 11 and 12 are used to control the mode amplitudes and the excitation sequences is described by equations 13 and 14.

In the above method, the initial excitation puts it in the right place so it then just decays. Percussion instruments are played by striking or plucking the instrument to excite the various oscillatory modes. However, the impact of the exciting object does not produce a perfect impulsive force, and a transient signal which does not at all fit the decaying sinusoid model may occur during the first several milliseconds of the instrument note's onset. It has been found to be especially true of xylophone notes.

In many cases, the realism of a synthesized note can be enhanced by incorporating a transient signal of a few hundred samples at the beginning of the note. When this excitation is used as an input to the lattice filter, however, the problems presented in the previous section are still present—for some arbitrary excitation input to the lattice filter, there is no guarantee that the modes of the system will be excited to the proper relative amplitudes. The method described in this section (step 513) overcomes this hurdle by finding an excitation which is as close as possible to a specified excitation signal, but still excites the modes properly. Then after a period of time, it is excited and it is let go to ring. An initial excitation of N sample is now provided.

To find an excitation signal for a given note, an inverse filtering procedure is performed on the input signal after the pole frequencies and radii are found as described above. Running the inverse of that filter on the original signal then gives the excitation signal. For an all pole filter, an inverse of the all pole filter is done which is an all zero filter with zeros where the poles have been. This inverse filter is simply a cascade of second order sections of the form $$Ak(z)=1-2r_k\cos(\omega_k)+r_k^2 \tag{15}$$

The resulting excitation signal is multiplied by a window which tapers it to zero over the final 10% of its duration to minimize boundary effects.

It is not desirable to just let it start to ring where it happens to be but the start to ring should be with the right conditions. The start should be in the right amplitude and so the right target state is determined. Given length N excitation signal $u_D[n]$ found via inverse filtering, $x_N$ (the target state at time N) must be specified to insure that the resulting oscillatory modes will be of the proper amplitudes. This state vector can be found in a manner similar to that described in the previous section. Once the initial amplitude $a_0$, the pole radius r, and the time index of the envelope maximum no are found, the desired amplitude at time N is found by $a_N=r^{N-n_0}$.

It would seem that the phase should be more or less arbitrary, as it was in the initial conditions case above, but this is not necessarily true. Experimentally, it has been found to be advantageous to set the phases of each partial at time N to be as close as possible to the actual phases that result from using $u_D[n]$ as the system input. For this purpose, a method for estimating these phases from the filter output signal has been developed.

The approximate frequencies of the filter output are known from the peak-picking analysis, and the decay constants of the modes are generally large enough that the sinusoid amplitudes can be considered almost constant over a small interval. Thus the filter response to the input $u_D[n]$ just after the excitation is turned off can be approximated by $$y_D[n]\approx\sum_{k=1}^{P/2}c_k e^{j\omega_k n}+c_k^* e^{-j\omega_k n} \tag{16}$$

over some "small" interval $N+1\leqq n\leqq N+M$. It is of interest to find the phase angles associated with the complex coefficients $\{C_k\}$. By looking only at the positive frequencies of $y_D[n]$ using a Hilbert transform operation similar to that in Equation (1), an optimal least-squares solution for the coefficients $\{C_k\}$ can be found as follows:

$$\underbrace{\begin{bmatrix} y[N+1]\\ y[N+2]\\ \vdots\\ y[N+M]\end{bmatrix}}_{y}=\underbrace{\begin{bmatrix}\vdots & \vdots & & \vdots\\ e^{jw_1 n} & e^{jw_2 n} & \cdots & e^{jw_{P/2} n}\\ \vdots & \vdots & & \vdots\end{bmatrix}}_{U}\underbrace{\begin{bmatrix} c_1\\ c_2\\ \vdots\\ c_{P/2}\end{bmatrix}}_{c} \tag{17}$$

The solution for the optimal coefficients c is then $$c_{opt}=(U^H U)^{-1}U^H y \tag{18}$$

where $U_H$ is the Hermitian transpose of U. The desired phases $\{\phi_k\}$ can be found from the phase angles of the complex coefficients $C_{opt}$. Finally, given the target amplitudes $a_k$ and phases $\phi_k$ at time N, the target state $x_N$ can be found via the eigendecomposition operation described in the section on the initial condition.

Given the target state $x_N$ and a desired input sequence $u_D[n]$, the task is to find an input to use $$C_{opt}=[u_{opt}[N-1], u_{opt}[N-2], \ldots, u_{opt}[0]]^T$$

which lies as close as possible to $u_D[n]$ and excites the modes to their proper amplitudes. Borrowing the notation for the controllability matrix of Equation (13), the problem can be phrased as follows:

Given $u_D[n]$, nonzero for $n\in[0, N-1]$, and a target state $x_N$, find an input $u_{opt}[n]$ such that $$x_N=Eu_{opt} \tag{19}$$

is satisfied and $$\in=\sum_{n=0}^{N}(u_D[n]-u_{opt}[n])^2 \tag{20}$$

is minimized over the range of all possible inputs u[n].

Since the Equation (19) represents an undetermined system of equations, it has a unique solution. However, any solution of (19) must be of the form $u=u^++u_N$, where $u^+$ is the row space of E and $u_N$ is the nullspace of E. The solution $u^+$ is unique; thus the problem above can be solved by first finding $u^+$, then finding a vector $u_N\in N(E)$ which lies as close as possible to the vector $u_D-u^+$.

The row space component can be found via the generalized inverse of E $$E^+=Q_2\Sigma^+Q_1^T \tag{21}$$

where $Q_2$, $\Sigma^+$, $Q_1^T$ are found by performing a singular value decomposition (SVD) of the matrix E. The matrix $\Sigma^+$ will be all zeros except for r nonzero entries along its main diagonal. The row space solution is then $$u^+=E^+x_N \tag{22}$$

The vector $u^+$ is the minimum energy solution to Equation (19).

To find the nullspace component $u_N$, the difference vector $u_N$, the difference vector $u_D-u^+$ must now be projected onto the nullspace of E. The matrix $Q_2^T$ from the SVD contains a basis for the nullspace of E in its last N−r columns. A new matrix V can be created by putting these nullspace basis vectors into its columns. Then, the projection of the difference vector onto the nullspace can be written $$u_N=VV^T(u_D-u^+) \tag{23}$$

Figure 9A:
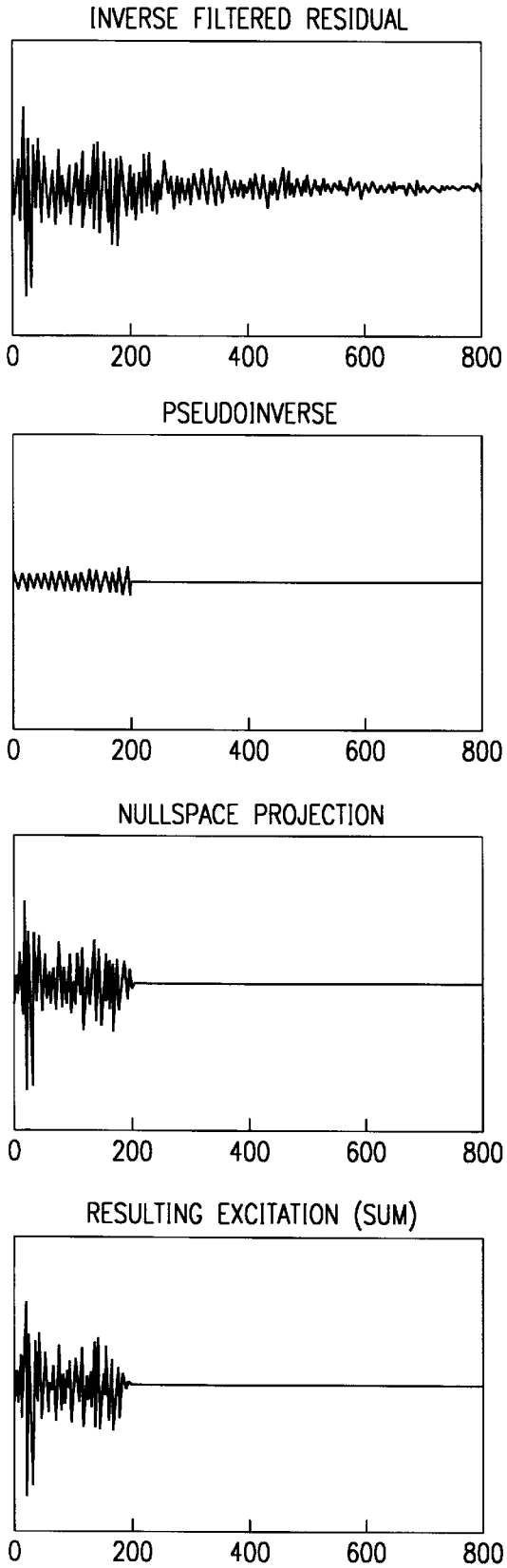
FIG. 9 are plots showing various elements of excitation decomposition where FIG. 9*a* (left side) are excitation signals and FIG. 9*b* (right side) are filter responses to excitation.
Figure 9B:
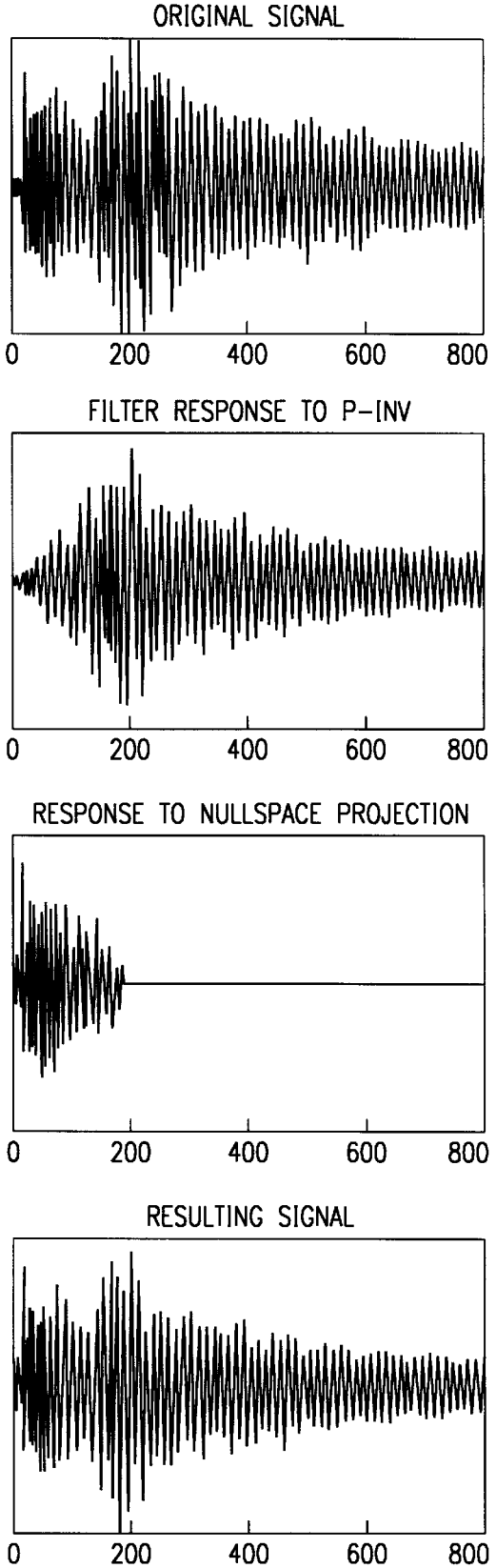

Finally, these two components can be combined into the final solution $$u_{opt}=u^++u_N \tag{24}$$

which can easily be shown to satisfy (19) and minimize the error in (20). An example of such a decomposition for a xylophone note can be seen in FIG. 9. It can be seen that the nullspace input $U_N$ looks very much like the desired input $u_D$, but results in a filter output that is zero after it is "turned off". The input $u^+$ is rather small in comparison, yet it is responsible for all of the nonzero filer response after the input is turned off.

To improve accuracy in the fixed-point synthesis implementation, the reflection coefficient parameters may be, for example, quantized to 12 bit representation before performing any of the matrix operations described in this and previous sections.

Equation 24 becomes the equation for the optimum excitation signal we want to use. In the synthesizer chip is the all pole lattice filter with the poles and the bandwidth and the filter is excited with $u_{opt}$ using N samples of the excitation signal from the memory 19.

Although the present invention and its advantages have been described in detail, it should be understood that various changes, substitutions and alterations can be made herein without departing from the spirit and scope of the invention as defined by the appended claims.

What is claimed is:

1. An apparatus for providing synthesis of a percussion sound comprising:

a microprocessor that implements an all pole lattice filter; and means for applying a single impulse signal to said microprocessor;

said filter having filter coefficients optimized for a desired percussion sound when said single impulse signal is applied;

said coefficients of said filter are provided by the steps of:

storing digital samples of the sounds of a desired musical note from a desired percussion instrument;

for that entire note generating a Fourier transform to get a spectrum of that note;

picking the peaks of the spectrum to select the most prominent components in the spectrum and determining wanted frequencies for decaying sine waves; and for the frequencies finding the time envelope and estimating therefrom the pole radius.

2. The apparatus of claim 1, wherein said filter coefficients are determined by the additional steps comprising:

for the wanted frequencies finding the amplitude envelope as a function of time for each picked peak;

estimating the pole radius by finding a correlation coefficient for said amplitude envelope;

determining initial amplitude of each decaying exponential by determining the amplitude that minimizes the squared error; and determining initial state such that modes of oscillation will have proper amplitude relationships with each other.

3. A method of analyzing a percussion musical instrument sound comprising the steps of:

storing digital samples of a musical note sound made by a percussion musical instrument;

generating a Fourier transform of said samples to get a spectrum of said note sound;

picking peaks of said spectrum of said note sound in said spectrum prominent components in said spectrum to determine wanted frequencies for decaying sine waves;

for the wanted frequencies finding an amplitude envelope as a function of time for each picked peak;

estimating pole radius by finding a correlation coefficient for said amplitude envelope;

determining initial amplitude of each decaying exponential by determining amplitude that minimizes the squared error; and determining initial state such that modes of oscillation will have the proper amplitude relationship with each other.

4. An apparatus for providing synthesis of a percussion sound comprising:

a microprocessor that implements an all pole lattice filter; and means for applying n samples of an excitation sequence to said microprocessor;

said filter having filter coefficients optimized for a desired percussion sound when said excitation sequence is applied;

said filter coefficients are provided by the steps of:

storing digital samples of the sounds of a desired musical note from a desired percussion instrument;

for that entire note generating a Fourier transform to get a spectrum of that note;

picking the peaks of the spectrum to select most prominent components in the spectrum and determining wanted frequencies for decaying sine waves; and for the frequencies finding time envelope and estimating therefrom the pole radius.

5. The apparatus of claim 4 wherein said filter coefficients are determined by the following steps comprising:

storing digital samples of percussion sound of a desired musical note from a desired musical instrument;

for said note generating a Fourier transform to get a spectrum of the note;

picking peaks of the spectrum at the selected most prominent components in said spectrum to determine wanted frequencies for decaying sine waves; and for the wanted frequencies finding amplitude envelope as a function of time for each picked peak;

estimating pole radius by finding a correlation coefficient for said amplitude envelope;

determining initial amplitude of each decaying exponential by determining amplitude that minimizes the squared error; and determining initial state such that modes of oscillation will have proper amplitude relationships with each other.

* * * * *